US008316916B2

(12) United States Patent
Heinrich et al.

(10) Patent No.: US 8,316,916 B2
(45) Date of Patent: Nov. 27, 2012

(54) METHOD FOR PRODUCING A PIPE

(75) Inventors: Peter Heinrich, Germering (DE); Peter Richter, Heldenstein (DE); Helmut Höll, Waldkraiburg (DE); Erik Bahr, Nuremberg (DE)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 13/281,690

(22) Filed: Oct. 26, 2011

(65) Prior Publication Data

US 2012/0273152 A1 Nov. 1, 2012

(51) Int. Cl.
*B22D 23/00* (2006.01)
*B21C 37/06* (2006.01)

(52) U.S. Cl. ..... 164/46; 164/479

(58) Field of Classification Search ..... 164/46, 164/479

See application file for complete search history.

(56) References Cited

U.S. PATENT DOCUMENTS 4,777,995 A * 10/1988 Reichelt et al. ..... 164/46
5,401,539 A 3/1995 Coombs et al.
5,983,495 A * 11/1999 Popoola et al. ..... 29/890.122

FOREIGN PATENT DOCUMENTS

DE 36 17 833 C1 9/1987
GB 1 599 392 9/1981
WO WO 2008/049460 A1 5/2008
WO WO 2009/109016 A1 9/2009

* cited by examiner

*Primary Examiner* — Kevin P Kerns
*Assistant Examiner* — Kevin E Yoon
(74) *Attorney, Agent, or Firm* — Philip H. Von Neida

(57) ABSTRACT

A method for producing a pipe, a carrier element being coated by means of a thermal spraying method, the material of the pipe formed later being selected as the coating material, and the coating forming the pipe being detached from the carrier element, the spraying angle, at which the coating material is sprayed onto the carrier element, being selected such that a low level of adhesion of the coating on the carrier element is achieved.

8 Claims, 2 Drawing Sheets

METHOD FOR PRODUCING A PIPE

CROSS REFERENCE TO RELATED APPLICATIONS

This application claims priority from German Patent application DE 102010060362.7 filed Nov. 4, 2010.

BACKGROUND OF THE INVENTION

The present invention relates to a method for producing a pipe, a carrier element being coated by means of a thermal spraying method and the material of the pipe formed later being selected as the coating material, and the coating forming the pipe subsequently being detached from the carrier element.

To produce seamless pipes, a block or a billet made of cylindrical steel is typically formed into a hollow, a short and thick-walled pipe. This hollow is then processed further in a following method step, for example, by the reciprocating rolling method or by skew rolling, to form a pipe of thinner diameter.

In more recent time, seamless pipes have also been produced by means of various thermal spraying methods. In this case, a coating material provided in powdered form is introduced into a heated processing gas jet. The powder particles melt or fuse. The processing gas is sprayed onto a carrier element by means of a spraying nozzle, so that a layer forms on the carrier element. The layer must meet two requirements. On the one hand, the layer must adhere to the carrier element during the method. Only in this way can a pipe having fixed specifications be produced. On the other hand, it is necessary for the coating material or, later, the finished pipe to be able to be detached as easily as possible from the carrier element, in order to avoid subsequent damage to the pipe.

A corresponding method is described, for example, in WO 2009/109016. In this case, seamless pipes are produced by means of a cold spraying method and the finished pipe is subsequently detached from the carrier element, in that the pipe and/or the carrier element are cooled or heated or alternatively the carrier element is melted, vaporized, or pulverized.

Depending on the layer thickness and the material of the coating material and of the carrier element, a high level or a low level of adhesion occurs between coating material and carrier element. A high level of adhesion has the result that the coating material adheres well on the carrier element during the spraying procedure, but is only to be detached from the carrier element with difficulty after being finished. This can result in an increased time and cost expenditure as a result of further method steps. In turn, a low level of adhesion has the result that the coating material adheres minimally or not at all to the carrier element during the spraying procedure, but is very easy to detach from the carrier element after manufacturing. This can again cause complications during the application of the layer on the carrier element.

It is therefore desirable to set the adhesion between coating material and carrier element so that the required adhesive properties and also layer properties can be guaranteed and production costs can simultaneously be minimized.

SUMMARY OF THE INVENTION

According to the invention, a method for producing a pipe, a carrier element being coated using a thermal spraying method, the material of the pipe formed layer being selected as the coating material, and the coating forming the pipe being detached from the carrier element characterized in that the spraying angle at which the coating material is sprayed onto the carrier element is selected such that a low level of adhesion of the coating on the carrier element is achieved is proposed. Advantageous embodiments of the invention are the subject matter of the subclaims and the following description.

According to the invention, a thermal spraying method is applied for producing a pipe, in particular a seamless pipe, by which a high adhesive tensile strength is provided. The adhesive tensile strength results from the relationship between adhesive properties and layer properties. While the layer properties are predominantly to be attributed to the materials of coating material and carrier element and to the gas and the temperature used for this purpose, the adhesive properties are adaptable or settable according to the invention via the spray angle. The spray angle is selected in the method according to the invention so that an adhesion results, which is sufficient so that the coating material adheres to the carrier element, and which is simultaneously low enough that the pipe can be detached more easily from the carrier element after finishing, without the application of more costly method steps. At the ideal spray angle, there is a minimal adhesion of the coating on the carrier material with optimum layer properties at the same time, which can be seen in that the coating or the later pipe is provided in dense and nonporous form. The introduction of a coolant within the carrier element and the shrinking procedure connected thereto are to be sufficient to detach the adhesion between coating material or pipe and carrier element.

At a spray angle of 90°, the processing gas is sprayed at a right angle onto the carrier element, so that a maximum adhesion forms between coating material and carrier element. At a spray angle of 0°, the processing gas is sprayed on parallel to the carrier element. No contact, and therefore also no adhesion, results between coating material and carrier element. A spray angle which induces sufficient adhesion between coating material and carrier element is accordingly between 0° and 90°. The above considerations apply similarly for the angle range from 90° to 180° (spraying from the "other side"). For the sake of simplicity, reference will only be made hereafter to the acute angle range (0° to 90°.

In a preferred embodiment, a flange-like layer is advantageously applied at an angle of 90° to the carrier element at the beginning of the thermal spraying method, so that a flank of the layer oriented toward the carrier element forms because of a specific layer thickness. The jet of the processing gas is subsequently oriented by means of the spraying device so that the angle to the flank of the layer is approximately 90°. The spraying device remains in this angle position until the completion of the coating, so that a uniformly dense and nonporous layer simultaneously having a low level of adhesion results.

A hollow mandrel is expediently selected as the carrier element, whose outer surface can be coated using the coating material. The pipe receives its shape as a result thereof. The corresponding diameter of the pipe can be selected depending on the mandrel size.

After the desired length of the pipe has been produced by coating the carrier element, the coating material must be detached from the carrier element. This is preferably performed by introducing a coolant into the hollow mandrel, so that the entire inner surface of the mandrel is cooled. The coolant can be carbon dioxide ($CO_2$) or nitrogen ($N_2$), in particular in the liquid phase.

The introduction of the coolant results in an abrupt shrinking procedure of the mandrel, the mandrel changing in its size, so that the coating material detaches from the mandrel without being damaged. After the mandrel has reached the ambient temperature again, it expands to its initial size and can be used for the next production method.

During the production of pipes according to the invention, a cold gas spraying method is preferably used as the thermal spraying method. The method is distinguished in that the powder particles of the coating material are not heated to the melting temperature, but are sprayed at high pressure onto the carrier element (temperature approximately 600° C., particle speed >1000 m/s). Layers of extreme adhesive strengths can be generated, which are extraordinarily dense and nonporous. Because of the relatively low temperature in comparison to other thermal spraying methods, the spraying material is only slightly thermally influenced and oxidized substantially less. The coated carrier material also does not display any material change because of the effect of heat. Methods of cold gas spraying are also described in Patent Specification WO 2009/109016.

The cold gas spraying method allows, inter alia, the use of titanium as a coating material. In the cold gas spraying method, the corrosion-resistant and temperature-resistant titanium is only heated enough that it can be applied by means of the cold gas spraying method to the carrier element, without losing its strength properties. At higher temperatures, the titanium would become brittle rapidly.

Aluminum is preferably used as the carrier element. Aluminum is a very corrosion-resistant element, which can be molded well at low temperatures. Upon introduction of coolant into the hollow mandrel, which comprises aluminum in the preferred embodiment, the mandrel shrinks, whereby the coating material detaches from the mandrel.

A preferred embodiment of the spraying system is designed so that the carrier element and the spraying device move relative to one another, in particular parallel to the surface of the carrier element, during the coating procedure. A movement of spraying device and carrier element at different speeds in the same direction is conceivable, as are opposing directions of carrier element and spraying device. It is also provided that either only the carrier element or only the spraying device moves in one direction.

Further advantages and embodiments of the invention result from the appended drawings and the exemplary embodiment shown therein.

It is obvious that the above-mentioned features and the features still to be explained hereafter are usable not only in the respective specified combination, but rather also in other combinations or alone, without leaving the scope of the present invention.

BRIEF DESCRIPTION OF THE FIGURES

The invention is schematically shown on the basis of exemplary embodiments in the drawings and is explained in greater detail hereafter with reference to the drawings.

DETAILED DESCRIPTION OF THE INVENTION

Figure 1:
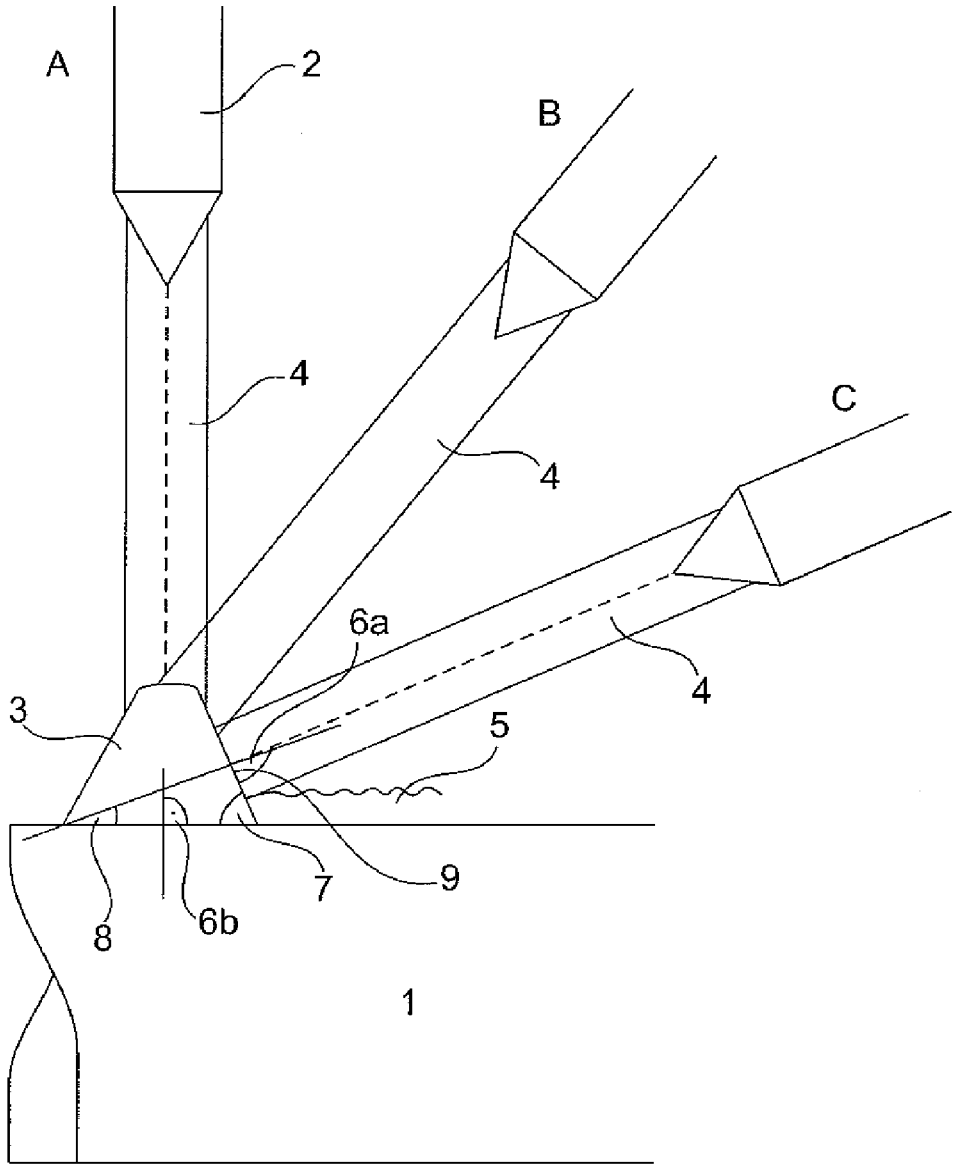
FIG. 1 shows the setting of the spraying device to select a spraying angle.

FIG. 1 shows the carrier element 1 in the form of a hollow mandrel, the spraying device 2, the flange-like layer 3, the processing gas jet 4, and the coating 5 comprising the coating material. The position A of the spraying device 2 is used for applying the flange-like layer 3 to the carrier element 1, the processing gas jet 4 being incident the carrier element 1 at the 90° angle 6*b*. Carrier element 1 and spraying device 2 do not move in relation to one another in the axial direction of the mandrel in this case. In this position, the processing gas jet 4 having the powdered coating material located therein is oriented perpendicularly to the carrier element 1, so that the flange-like layer 3 forms having a specific height, preferably 0.5 to 20 mm. The finished pipe is then approximately as thick as the flange. After the flange-like layer 3 has reached the predefined layer thickness, the position of the spraying device 2 changes. This is illustrated by an intermediate position B. Before the actual coating procedure is begun, the exact position C of the spraying device 2 is selected. For this purpose, the processing gas jet 4 is oriented by means of the spraying device 2 at a right angle 6*a* to the flank 9 of the flange-like layer 3. The angle 6*a* between the propagation direction of the processing gas jet 4 and the flank 9 of the flange-like layer 3 is therefore essentially 90°, a possible deviation from the right angle not being greater than +/−10°.

Figure 1A:
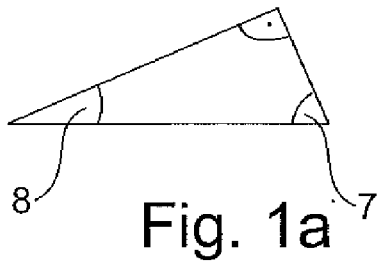

In addition to the 90° angle 6*a*, two further angles which are significant also result. Firstly, the flank angle 7 and the spraying angle 8. In the extension of the processing gas jet 4, an angle forms between this extension and the carrier element 1. This angle is described as the spraying angle 8, since it describes the angle at which the coating material is incident on the carrier element 1. Simultaneously, a flank angle 7 forms between the flank 9 and the carrier element 1. This describes the angle at which the flank 9 of the flange-like layer 3 stands to the carrier element 1. The spraying angle 8 can be calculated with the aid of the flank angle 7, which can be measured. Because of the fact that the three internal angles of a triangle result in an angle sum of 180°, the following equation may be set up for the triangle visible in the separate detail of FIG. 1*a*:

$$90° + \text{flank angle (7)} + \text{spraying angle (8)} = 180°$$

$$\text{Spraying angle (8)} = 90° - \text{flank angle (7)}$$

After the spraying device 2 has been brought into the position C, a uniform layer 5 of the coating material is sprayed onto the carrier element 1, the coating 5 having optimum layer properties with little adhesion.

Figure 2:
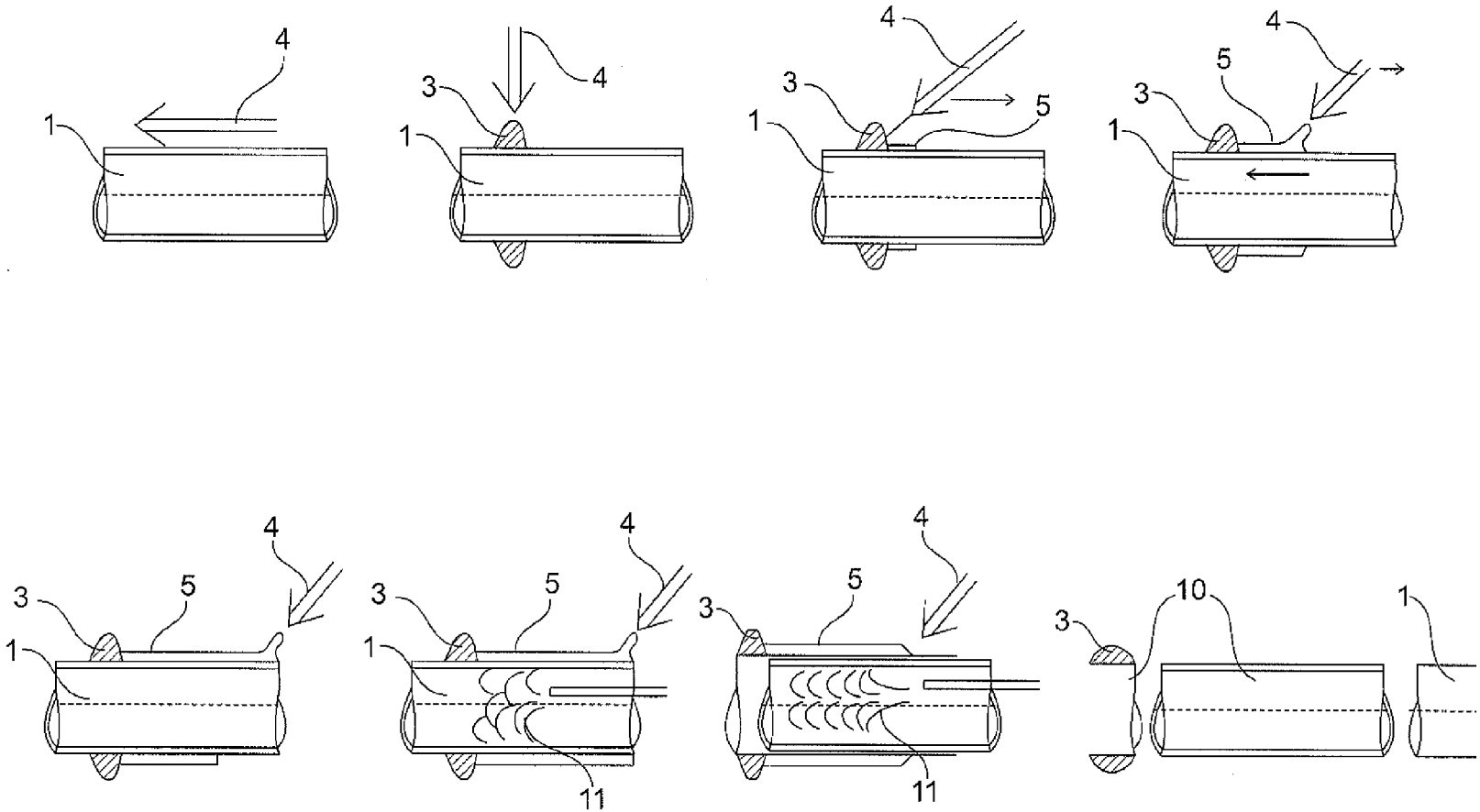
FIG. 2 shows a method for producing a pipe in its individual steps.

FIG. 2 shows the successively executed method steps of the invention, scene 1 showing a spraying angle 8 of 0° only as an example and therefore not being viewed as a method step.

The method according to the invention begins with scene 2. In scene 2, the flange-like layer 3 is first sprayed onto the carrier element 1, the spraying device 2 being oriented at the 90° angle 6*b* to the carrier element 1. In scene 3, the spraying device 2 is changed in its location so that the processing gas jet 4 is located at the 90° angle 6*a* to the flank 9 of the flange-like layer 3. The spraying device 2 moves in scene 3 in the axial direction of the mandrel and parallel to the surface of the carrier element 1, for example, while the mandrel 1 rotates around its longitudinal axis, in order to form the pipe periphery. In scene 4, the beginning of a coating 5 of the coating material on the carrier element 1 may be recognized. In scene 5, the coating 5 of the carrier element 1 has progressed enough that the entire section of the mandrel is already covered by the coating material 5. In scene 6, the coating 5 of the coating material is now to be detached from the carrier element 1, in that a particularly liquid coolant 11 comprising $CO_2$ or $N_2$ is introduced into the hollow mandrel. During the cooling procedure, if it is an endless pipe, the spraying procedure can be performed further. In scene 7, both the mandrel and also the spraying device 2 are at a standstill, so that the pipe 10 can be drawn off of the mandrel 1. Further coolant 11 is simultaneously injected into the hollow mandrel, in order to avoid cracks or other side effects during the detachment from the mandrel. In scene 8, the separation procedure between pipe 10 and mandrel is shown in the advanced stage. After the pipe 10 has been completely detached from the carrier element 1 or the mandrel, the finished pipe 10 having predetermined diameter made of the selected material, in particular titanium, having the desired layer thickness and the corresponding optimum layer properties is provided.

List of Reference Numerals

1 carrier element
2 spraying device
3 flange-like layer
4 processing gas jet
5 coating
6*a* angle in relation to flange-like layer
6*b* angle in relation to carrier element
7 flank angle
8 spraying angle
9 flank
10 pipe
11 coolant

What we claim is:

1. A method for producing a pipe, a carrier element being coated using a thermal spraying method, a material for producing the pipe being selected as the coating material, and the coating forming the pipe being detached from the carrier element characterized in that spraying a flange-like layer onto the carrier element at a spraying angle of 90° at the beginning of the thermal spraying method, so that a flank oriented toward the carrier element forms because of a specific layer thickness of the flange-like layer;

and thereafter selecting an angle, which is essentially perpendicular to the flank of the flange-like layer oriented toward the carrier element as the spraying angle for the coating forming the pipe, and continue spraying to produce the pipe.

2. The method according to claim 1, characterized in that a hollow mandrel is selected as the carrier element, wherein an external surface of said hollow mandrel can be coated.

3. The method according to claim 2, characterized in that a coolant is conducted into the hollow mandrel to detach the coating material from the carrier element.

4. The method according to claim 3, characterized in that the coolant is selected from the group consisting of liquid $CO_2$ and $N_2$.

5. The method according to claim 1, characterized in that a cold gas spraying method is used as the thermal spraying method.

6. The method according to claim 1, characterized in that the coating material is titanium.

7. The method according to claim 1, characterized in that the carrier element is aluminum.

8. The method according to claim 1, characterized in that the carrier element and a spraying device move relative to one another during the coating method.

* * * * *